United States Patent [19]

Fernandez

[11] 4,387,924

[45] Jun. 14, 1983

[54] COMBINATION BACK PACK AND SEAT

[76] Inventor: Frank J. Fernandez, P.O. Box 348, Sound Beach, N.Y. 11789

[21] Appl. No.: 203,648

[22] Filed: Nov. 3, 1980

[51] Int. Cl.[3] ..... A47C 9/10; A47C 7/62

[52] U.S. Cl. ..... 297/188; 297/217; 224/155

[58] Field of Search ..... 297/217, 188, 118; 224/155, 153

[56] References Cited

U.S. PATENT DOCUMENTS

| | | | |
|---|---|---|---|
| 1,615,159 | 1/1927 | Bonner | 224/155 |
| 2,922,465 | 1/1960 | Johansson et al. | 224/155 |
| 2,973,888 | 3/1961 | Beardsley | 224/155 |
| 3,158,299 | 11/1964 | Weir et al. | 224/153 |
| 3,315,856 | 4/1967 | Black | 224/155 |

FOREIGN PATENT DOCUMENTS

| | | | |
|---|---|---|---|
| 1165671 | 6/1958 | France | 297/188 |
| 88734 | 3/1937 | Sweden | 224/155 |
| 1408238 | 10/1975 | United Kingdom | 224/155 |

*Primary Examiner*—Francis K. Zugel
*Attorney, Agent, or Firm*—Richard L. Miller

[57] ABSTRACT

A combination back pack and seat is provided where a seat portion is rigidly connected to a back pack to allow for two modes of operation. Two bent-leg portions having a U-shape are pivoted together in scissor-like manner to provide for a support for a nylon fabric constituting the supporting surface of the seat portion. Straps are connected to the two bent-leg portions to provide for the carrying of the back pack when in the back pack mode of use.

7 Claims, 2 Drawing Figures

COMBINATION BACK PACK AND SEAT

BACKGROUND OF THE INVENTION

The present invention is directed to a device for use in recreational and sporting environments, such as hiking, camping, and the like. Under such circumstances, it is often desirable to be able to rest after long walks.

SUMMARY OF THE INVENTION

It is, therefore, the object of the present invention to provide a combination back pack and seat rigidly connected together so that after long walks the device may be converted into a seat upon which one may rest.

Accordingly, the combination of the present invention has a back pack portion and a seat portion rigidly connected to the rear surface of the back pack. The back pack is of conventional design having a receptacle and lid therefor, while the seat portion is comprised of two U-shaped leg portions pivoted together in scissor like manner.

The U-shaped leg portions are of slightly different widths to allow for one leg portion to fit inside the other into a closed non-use position. Straps are provided which are fastened to the U-shaped bent leg portions by which the back pack may be carried. A cross-strap is connected at the lowermost ends of the U-shaped leg portion that is wider than the other, whereby the two leg portions are prevented from unfolding to their open "use" position when the device is used as a back pack. Structural integrity of the seat portion of the device is provided by the back pack itself, so that the two leg portions do not collapse. A nylon fabric stretched between the horizontal parts of the two U-shaped leg portions provides the actual seat support upon which to sit.

BRIEF DESCRIPTION OF THE DRAWING FIGURES

The invention will be more readily understood with reference to the accompanying drawing, wherein FIG. 1 is a perspective view of the invention in the unfolded, sitting-oriented mode of use; and FIG. 2 is a perspective view of the invention when in its back pack mode of operation.

DETAILED DESCRIPTION OF THE INVENTION

Figure 1:
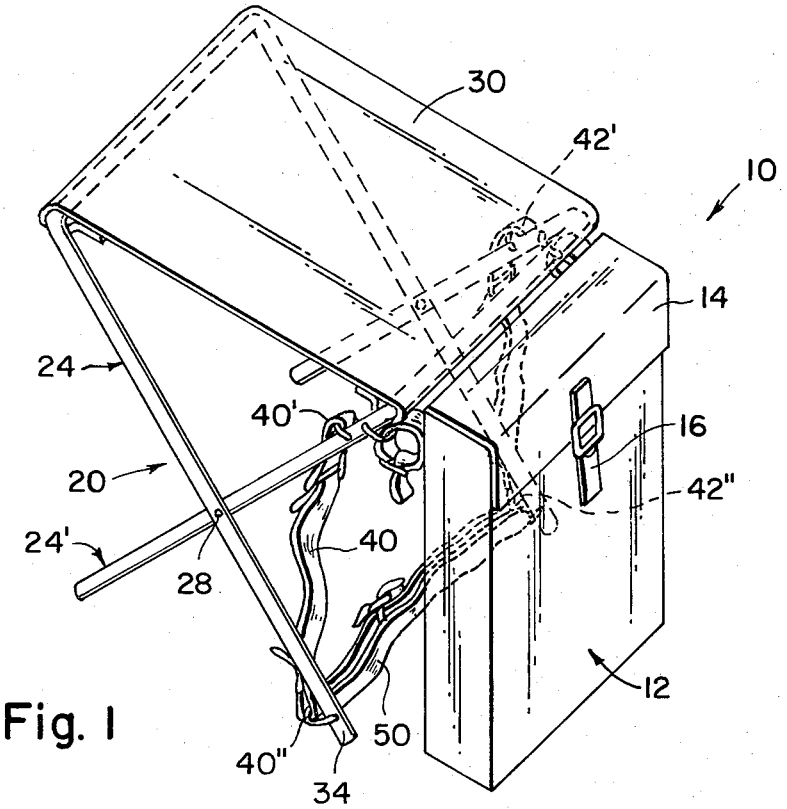

Referring to FIG. 1, the combinatin back pack and seat of the present invention 10 is shown in its unfolded, seat-oriented position. The back pack portion 12 is of conventional design having receptacle means secured in a closed position by flap 14 and fastening means 16. Attached to the rear surface of the back pack 12 is the seat portion 20 of the combination of the present invention. This seat portion is fixedly attached to the rear surface of the back pack by conventional means, such as a pair of sleeves, one at each end of the rear surface, or any other suitable fastening means. The seat portion 20 is made up of a first U-shaped bent-leg portion 24 and a second U-shaped bent-leg portion 24'. The width of bent-leg portion 24' is a bit less than the width of the bent-leg portion 24 in order that the two bent-leg portions may be pivoted relative to each other by pivot pins 28, 28'. Fixedly connected across the width of each U-shaped bent-leg portion, and spanning the distance therebetween, is a nylon fabric 30 which defines the area for sitting. The nylon fabric 30 is sufficiently flexible enough to fold into a compact U-shaped configuration when the bent-leg portions are pivoted toward each other when in the non-use position. The nylon fabric 30 is of suficient length as to wrap around the horizontal portions of each bent-leg portion and be secured firmly thereby, by any conventional means. It will be noted in FIG. 1, when the device of the present invention is in its sitting-oriented mode of operation, the back pack 12 provides the requisite support to prevent the collapse of the two bent-leg portions. For this reason, it is necessary to make the ends 34, 34' of the bent-leg portions sufficiently adjacent to the rear surface of the back pack 12 so as to prevent tipping.

The bent-leg portions 24 and 24' are preferably made of aluminum tubing. Typical dimensions are: $\frac{5}{8}$ inch diameter tubes for the leg portions; a height of 14 inches and a width of 12 inches for the back pack portion; a length of 15 inches and a width of 14 inches for the nylon fabric 30; a width of 13 inches for the bent-leg portion 24' and a width of $14\frac{1}{2}$ inches for the bent-leg portion 24; and a length of 21 inches for each bent leg portion taken in the direction perpendicular to the width of the bent-leg portions. With these dimensions, when the device is in its sitting-oriented mode of operation, the nylon fabric 30 will be about 15 inches above the plane of the ground or other supporting plane. Thus, the distance from the rear surface of the back pack portion to the ends 34, 34' is solely determined by the width of the fastening means connecting the rear surface of the back pack to the bent-leg portion 24', which allows for greater sturdiness in the unfolded position.

Figure 2:
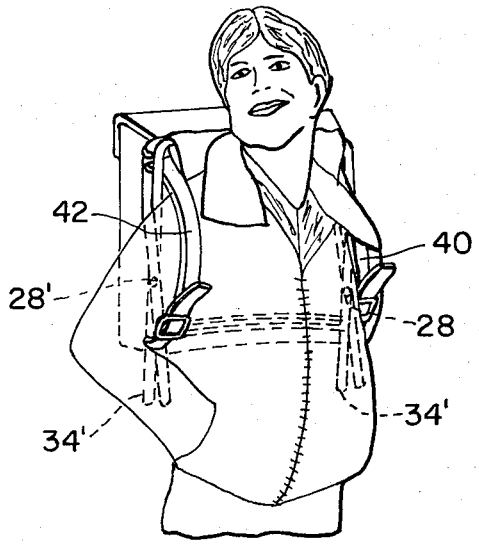

When the device of the present invention is used as a simple back pack, the seat portion 20 is moved to its nonuse position by simply pivoting in scissor-like fashion the two bent-leg portions 24, 24', as can be seen in FIG. 2. The device is used as a back pack by means of straps 40, 42 which are secured to the U-shaped bent-leg portions 24, 24', as is best seen in FIG. 1. Strap 40 is fastened at one end 40' to the bent-leg portion 24', while the other end 40'' is fastened to the bent-leg portion 24, by conventional fastening means. Likewise, the strap 42 is fastened to the bent-leg portion 24' at one end 42', and to the bent-leg portion 24 at end 42'', also by conventional fastening means. Cross strap 50 is extended between the two lowermost ends of the bent-leg portion 24 to provide further integrity to the structure when in the sitting-oriented mode of operation, and also to prevent the accidental opening of the bent-leg portions during the carrying thereof in the back pack mode of operation.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. The combination back pack and seat comprising, in combination, a back pack portion comprising receptacle means for storing items therein; a seat portion fixedly connected to said back pack portion; and means for fixedly connecting said back pack and said seat portion to each other, whereby two modes of operation are provided, the first as a back pack and the second as a seat, said seat portion comprising first and second bent-leg portions, each being pivotally connected to the other to pivot in a scissor-like manner, each said bent-leg portions being U-shaped and having a pair of vertical legs interconnected by a horizontal bight portion, the horizontal bight portion of said first bent-leg portion being coupled to the rear surface of said back pack portion, first and second shoulder straps for use during the back pack mode of operation of the combination, said first shoulder strap having a first end fixedly connected to one vertical leg of said first bent-leg portion adjacent to its interconnection to its horizontal bight portion, and a second end connected to its pivotally connected vertical leg of said second bent-leg portion adjacent the free end thereof, and said second shoulder strap having a first end fixedly connected to the other vertical leg of said first bent-leg portion adjacent to its interconnection to its horizontal bight portion and a second end connected to its pivotally connected leg of said second bent-leg portion adjacent to the free end thereof, whereby the back pack may be carried by a person.

2. The combination according to claim 1, wherein the width of said first bent-leg portion is less than the width of said second bent-leg portion.

3. The combination according to claim 1, wherein said seat portion comprises a means extending from the horizontal bight portion of said first bent-leg portion to the horizontal bight portion of said second bent leg portion for sitting support.

4. The combination according to claim 3, wherein said means extending between said first and second bent-leg portions comprises a flexible fabric foldable into a compact position.

5. The combination according to claim 1, wherein said seat portion further comprises a cross-strap extending between the lowermost free ends of the legs of said second bent leg portion, whereby the first and second bent-leg portions are prevented from pivoting relative to each other in scissor-like fashion when in the back pack mode of operation.

6. The combination according to claim 5, wherein said means for fixedly connecting said back pack portion to said seat portion comprises means fixedly connected to the rear surface of said back pack portion and fixedly connected to the horizontal bight portion of said first bent-leg portion.

7. The combination according to claim 6, wherein each said first and second bent leg portions comprises aluminum tubing.

* * * * *